United States Patent [19]

Shih

[11] Patent Number: 4,712,645

[45] Date of Patent: Dec. 15, 1987

[54] FIRE ESCAPE DEVICE

[76] Inventor: Tzyy Z. Shih, No. 9, Lane 2, Hsinchung Street, Taipei, Taiwan

[21] Appl. No.: 947,363

[22] Filed: Dec. 29, 1986

[51] Int. Cl.[4] ..... A62B 1/08

[52] U.S. Cl. ..... 182/5; 182/231; 182/236; 188/83; 188/166; 188/80

[58] Field of Search ..... 182/5–7, 182/231, 235, 236, 240, 71, 72, 232–234, 75, 237–239; 188/83, 85, 166, 74, 80

[56] References Cited

U.S. PATENT DOCUMENTS

| | | | |
|---|---|---|---|
| 287,940 | 11/1883 | Johnson | 182/231 |
| 419,542 | 1/1890 | Nittinger | 182/71 |
| 646,635 | 4/1900 | Cabus | 182/237 |
| 2,493,853 | 1/1950 | Bossetta | 188/85 |
| 3,306,582 | 2/1967 | Copeland | 182/240 |
| 4,091,907 | 5/1978 | Tabler | 188/80 |
| 4,198,033 | 4/1980 | Messziene | 182/5 |
| 4,367,863 | 1/1983 | Dulondel | 182/5 |
| 4,493,396 | 1/1985 | Borgia | 182/238 |

FOREIGN PATENT DOCUMENTS

| | | | |
|---|---|---|---|
| 87650 | 9/1983 | European Pat. Off. | 182/231 |
| 4636 | of 1914 | United Kingdom | 188/85 |

*Primary Examiner*—Reinaldo P. Machado
*Assistant Examiner*—A. Chin-Shue
*Attorney, Agent, or Firm*—Steinberg & Raskin

[57] ABSTRACT

A fire escape device suitable for receiving a person or persons to be safely descended from a relatively high elevation to the ground. The device includes a substantially box-like housing which contains a drum with a supporting cable and gear system. A basket is suspended at the base of the housing whereby a person or persons is/are lowered.

8 Claims, 4 Drawing Figures

FIRE ESCAPE DEVICE

BACKGROUND OF THE INVENTION

This invention relates to a fire escape device and more particularly to a device adapted to receive people, whereby the people may be safely lowered to the ground from a relatively high building.

Nowadays, the ever increasing metropolitan population and the dwindling urban land are pushing the new buildings to become higher and higher. Accordingly, fire fighting and rescuing for the fireman are becoming more and more difficult, and fire accidents are becoming more and more disastrous and causing more casualties than ever before. To enable the occupants of the house to escape from a building on fire, various devices have been developed, however, none of them proved satisfactory. Therefore, a reliable escaping device is urgently required.

It is the purpose of the present invention, therefore, to mitigate and obviate the above-mentioned drawbacks in the manner set forth in the detailed description of the preferred embodiment.

SUMMARY OF THE INVENTION

A primary objective of this to invention is to provide a fire escape device for lowering a person or persons to the ground from a high building.

Another objective of this invention is to provide a simple and practical fire escape device which can be easily operated and is inexpensive to manufacture.

Another objective of this invention is to provide a fire escape device which includes speed controlling means for effectively enabling the user to control the device.

A further objective of this invention is to provide a fire escape device for lowering a person or persons to the ground with a very steady speed.

Further objectives and advantages of the present invention will become apparent as the following description proceeds, and the features which characterize the invention are pointed out with particularity below.

DETAILED DESCRIPTION OF THE PREFERRED EMBODIMENT

Figure 1:
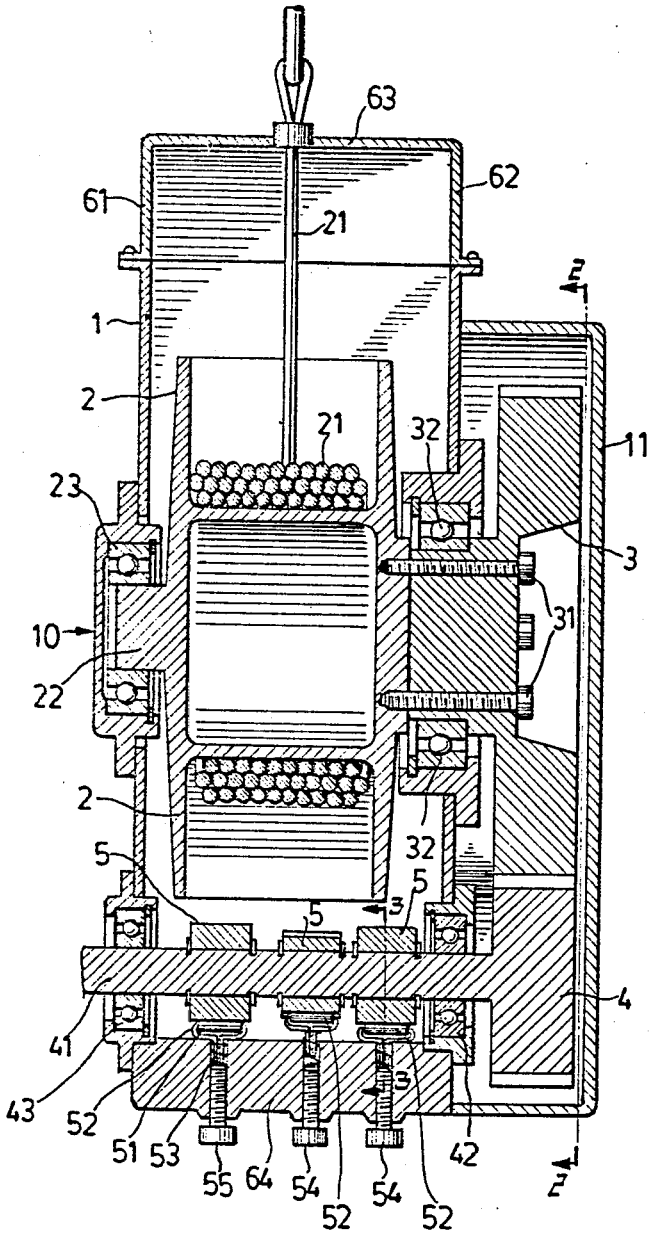
FIG. 1 is a vertical cross-sectional view of the preferred embodiment of the present invention.
Figure 2:
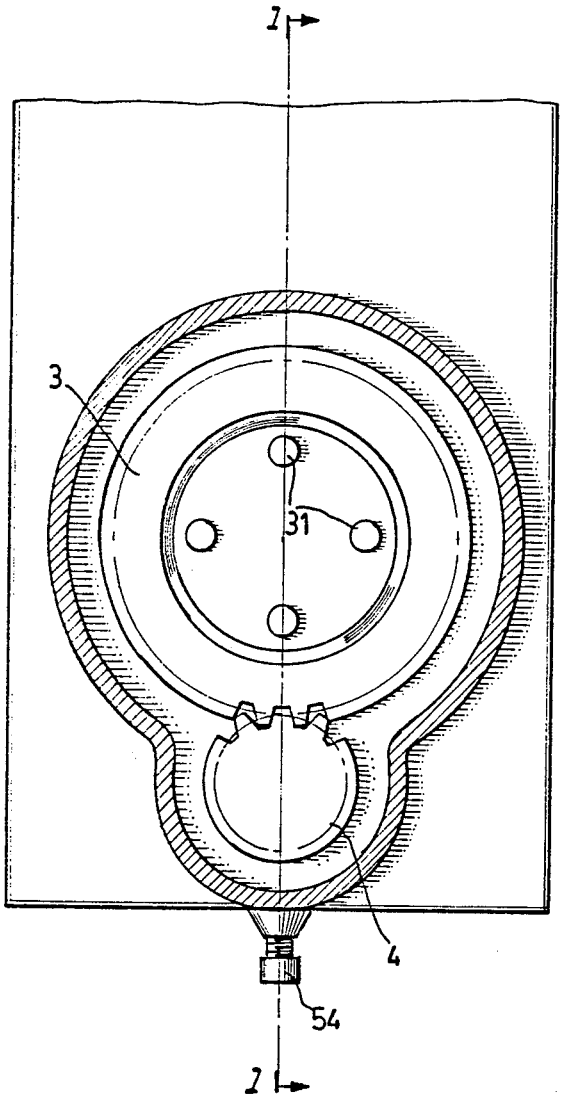
FIG. 2 is a front view of the preferred embodiment, showing two sets of gears.

Referring now to the drawings in more detail, in particular to FIG. 1, reference numeral (10) refers to the fire escape device according to the present invention. The fire escape device (10) comprises a supporting cable (21), a drum (2) with the supporting cable (21) wound about the same, two gear systems (3,4) and a speed controlling device comprising three fastening rings (5) with spring-controlled compression rollers (51).

The device (10) includes a generally box-like housing (1) which is preferably constructed of metallic material such as steel plate or the like. The housing (1) comprises parallel side walls (61,62) and horizontal top and bottom walls (63,64), and an exterior cover (11) is mounted at one of the parallel side wall. The drum (2) with shaft (22) is extended across the interior of said housing (1) and rotatably journaled at the parallel side walls (61,62) by means of bearings (23,32) for rotation therewith. The supporting cable (21) is extended through the top wall (63) and wound around said drum (2). At one face of said drum (2), the first gear system (3) is mounted by screw (31) therein and is supported at said side wall (62) by the bearing (32). As a result, the rotation of first gear (3) is simultaneous with said drum (2). The second gear (4) is rotatably mounted with shaft (41) thereof extending across said parallel side walls (61) (62) and supported by bearings (42) and (43). The first and second gear systems (3) (4) are positioned exteriorly of side wall (62) but within said exterior cover (11), and said gears (3) (4) are engaged with each other such that the rotation of said gears (3) (4) is simultaneous.

Figure 3:
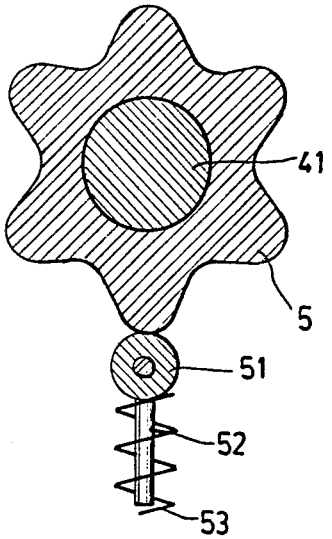
FIG. 3 is an enlarged cross-sectional view of a fastening ring with compression roller, taken substantially on the plane of the line 3—3 of FIG. 1.

Referring to FIGS. 1 and 3 mounted on shaft (41) are three fastening rings (5) which are firmly secured in parallel. The surface of the fastening rings (5) is wave-like shaped with convex protrusion and concave depression. Said fastening rings (5) are individually provided with corresponding screws (54,55) and at the top portion of said screw (54,55) a compression roller (51) is positioned such that at least one of the said rollers (51) is in contact with the convex protrusion of said fastening rings (5) and at least one of said compression rollers (51) is in contact with the concave depression of said fastening rings (5). In this manner, the contact between said compression roller (51) and fastening ring (5) is always at an appropriate frictional force.

Referring to FIG. 3, a supporting rod (52) is provided at the core of said compression roller (51) and supported by screws (54,55), and a spring (53) is provided below the roller (51). By means of screws (54,55) which are mounted at the horizontal bottom wall (64) of said housing (1), the adjustment of said screw (54,55) will compress the spring (53), such that said roller (51) and fastening ring (5) will cause an appropriate frictional force.

The three screws (54,55) are provided with the same function which control the rotation of gear (4). The only difference between screw (54) and screw (55) is that said screws (54) are preset before the device (10) is in operation.

Figure 4:
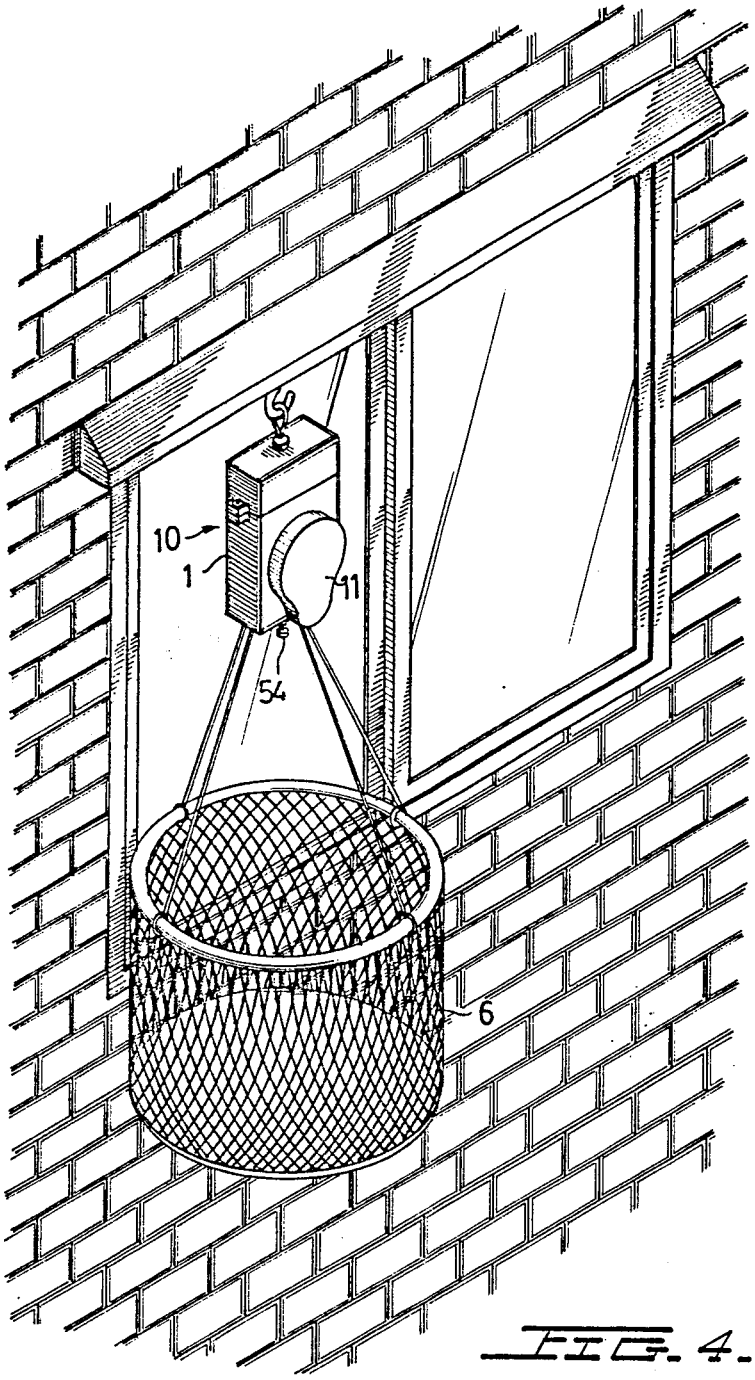
FIG. 4 is a perspective view showing the application of the device to allow safe escape.

As shown in FIG. 4, when such device (10) is to be used during a fire, a basket (6) is suspended onto a hook (not shown) at the bottom wall (64) of the housing (1). The supporting cable (21) passes through the top wall (63) of said housing (1) and is secured to a hook-like object at a building. When the basket (6) is occupied with people, the weight of the occupants causes the drum (2) to rotate, and at the same time, the supporting cable (21) is withdrawn from the housing (1). Thus, this allows the device (10) to be lowered to the ground. The speed of descending is dependent on the rotation of drum (2). Additionally, the rotation of first gear 93) and drum (2) is simultaneous. As said first gear (3) is engaged with the second gear (4), when the second gear (4) is driven by the first gear (3), the speed of lowering of the device (10) is thus increased. However, the frictional force between the fastening ring (5) at shaft (41) of second gear (4) and the compression roller (51) reduces the speed of rotation of second gear (4). As the screw (54) is preset before use, there is therefore a definite frictional force between the compression roller (51)

and said fastening ring (5). During the descending procedure, the speed of lowering can be controlled by adjusting the screw (55). The outer surface of basket 96) can be optionally covered with a sheet of fire-proof material, thus the person or persons in the basket will be shielded from burning. Since this device is operated by the weight of the occupants in the basket, and does not require external energy, it is therefore reliable and durable.

Accordingly, in view of the above description, it should be readily apparent that the fire escape device (10) provides means for lowering a person or persons from a building, and the device allows the speed of descending to be controlled.

I claim:

1. A fire escape device, comprising:

a supporting cable adapted to be connected, at one end thereof, to a fixed point, a housing, including a pair of side walls and top and bottom walls, a drum comprising a shaft thereof extending across an interior of said housing and rotatably mounted in said side walls, with said supporting cable being wound upon said drum at an opposite end thereof and being unwindable therefrom such that said housing can be lowered with respect to said fixed point, a first gear mounted upon said drum to be rotatable therewith, a second gear engagable with said first gear and rotatably journaled on an exterior of one of said housing side walls, said second gear comprising a shaft extending across the housing interior, three fastening rings securely mounted upon said shaft of said second gear, three corresponding compression rollers, each being mounted directly below a respective one of said fastening rings and being mounted upon said bottom housing wall, and being in continuous contact with said respective rings, and each of said rings comprising a wavelike outer circumferential surface having at least one convex protrusion and at least one concave depression, with at least one of said compression rollers contacting a respective ring at said convex protrusion thereof, and at least one other compression roller contacting a respective ring in said concave depression thereof.

2. The device of claim 1, wherein said cable extends through said top housing wall.

3. The device of claim 1, additionally comprising a basket connected to said bottom wall of said housing, and which is lowerable therewith with respect to the fixed point.

4. The device of claim 1, wherein said top and bottom walls are substantially horizontal when mounted on the fixed point, and said sidewalls are substantially parallel with one another.

5. The device of claim 1, additionally comprising three supporting rods, each roller mounted upon a respective supporting rod at its core, three screws mounted in said housing bottom wall, each screw supporting a respective one of said supporting rods, and three springs, each spring provided about a respective one of said supporting rods, adjustment of each of said screws compressing said respective spring and thereby applying appropriate frictional force between said respective ring and roller.

6. The device of claim 5, wherein one of said three screws is pre-set before use.

7. The device of claim 1, additionally comprising a cover situated about said first and second gear and mounted upon said housing sidewall on which said second gear is rotatably journaled on the exterior thereof.

8. The device of claim 7, wherein said first gear is also rotatably journaled on the exterior of said housing sidewall.

* * * * *